United States Patent [19]

Thatcher

[11] Patent Number: 4,502,621

[45] Date of Patent: Mar. 5, 1985

[54] PAPER DISPENSING APPARATUS

[76] Inventor: Richard E. Thatcher, 10709 Lunswood Rd., Chester, Va. 23831

[21] Appl. No.: 480,256

[22] Filed: Mar. 30, 1983

[51] Int. Cl.[3] ..... B26F 3/02; B65H 35/10

[52] U.S. Cl. ..... 225/16; 226/127; 242/55.53; 225/77

[58] Field of Search ..... 242/55.53, 55; 225/16, 225/10–14, 39, 46, 53, 76, 78; 226/127–130, 68

[56] References Cited

U.S. PATENT DOCUMENTS

| | | | |
|---|---|---|---|
| Re. 21,678 | 12/1940 | Dakin | 225/46 |
| 655,196 | 8/1900 | Church et al. | 226/127 |
| 1,405,283 | 1/1922 | Christian | 242/55.53 |
| 1,498,242 | 6/1924 | Lalonde | 226/127 |
| 2,232,968 | 2/1941 | Price et al. | 242/55.53 |
| 2,839,345 | 6/1958 | Engel et al. | 312/39 |
| 2,930,610 | 3/1960 | Swartze | 226/68 |
| 2,973,958 | 3/1961 | Casey et al. | 226/130 |
| 3,628,743 | 12/1971 | Bastian et al. | 242/55.3 |
| 3,653,733 | 4/1972 | Wyant | 312/39 |
| 3,700,181 | 10/1972 | Diring et al. | 242/55.3 |
| 3,917,191 | 11/1975 | Graham, Jr. et al. | 242/55.3 |

*Primary Examiner*—Leonard D. Christian

*Attorney, Agent, or Firm*—Norman B. Rainer

[57] ABSTRACT

Apparatus is provided for controllably dispensing paper tissue from a spirally wound roll on a hollow core. The apparatus is comprised of holding means having a vertically oriented front panel, a floor and two side retaining members. The paper roll is supported on the floor such that the core is disposed horizontally and perpendicularly to the side members. A paper engaging means, supported by the holding means, and adapted for reciprocal motion in a linear path, advances the paper through an opening when moved in one direction, and does not move the paper when moved in the reverse direction.

11 Claims, 4 Drawing Figures

PAPER DISPENSING APPARATUS

BACKGROUND OF THE INVENTION

This invention relates to dispensing mechanisms, and more particularly concerns apparatus for holding and controllably dispensing paper tissue or other webs from rolls.

Paper tissues made for kitchen or toilet use are commonly packaged as continuous webs in the form of rolls wound spirally upon a cylindrical tube core. For dispensing purposes, the core is horizontally mounted upon a holder or dispenser device permitting free rotation of the roll about the core axis with attendant tensionless unwinding and downward travel of tissue from the roll. Lengths of tissue of required size are torn from the roll either by virtue of pre-existing perforations in the web parallel to said axis, or by severing means associated with the holder.

Some dispenser devices may however on occasion accidentally release the roll of tissue. Those devices which more assuredly retain the rolled tissue generally involve mounting techniques which are inconvenient or time-consuming. In those instances where the core is mounted upon a spindle removably associated with the dispensing apparatus, the spindle may in time become lost or stolen. In certain public and industrial environments, it is necessary to protect the mounted roll of tissue from inadvertent or deliberate damage, and also to minimize the ease of removal of unlimited quantities of tissue. In residential use, it is often desired to conceal the mounted roll of tissue to preserve the decor of a room while not adversely affecting the function of the dispenser.

It is accordingly an object of the present invention to provide a dispenser apparatus which concealably and protectively houses a roll of paper tissue and permits removal of tissue from said roll in a controllable manner.

It is another object of this invention to provide a dispenser apparatus as in the foregoing object permitting easy insertion of a roll of paper tissue, and having no easily removable parts.

It is a further object of the invention to provide an improved dispenser apparatus of simple and rugged construction which may be economically manufactured.

These objects and other objects and advantages of the invention will be apparent from the following description.

SUMMARY OF THE INVENTION

The above and other beneficial objects and advantages are accomplished in accordance with the present invention by an improved tissue dispensing apparatus which comprises:

(a) holding means for functionally supporting and positioning a roll of spirally wound paper on a hollow core comprised of two opposed side retaining members, a front panel and a floor which extends forwardly toward said front panel, said front panel being adapted to be vertically oriented, said floor being substantially perpendicularly disposed to said side retaining members which are spaced apart sufficiently to accommodate therebetween said roll of paper supported by said floor in a manner such that said core is horizontally disposed, (b) an opening within said holding means associated with the forward extremity of said floor in perpendicular orientation to said side retaining members and adapted to permit passage therethrough of paper from said roll, (c) paper engaging means supported by said holding means and adapted for reciprocal motion in a linear path, said paper engaging means being adapted to grip the paper of said roll when moved in one direction, and not grip said paper when moved in the reverse direction, and (d) means for forcing said roll of paper into contact with said engaging means.

In a preferred embodiment of the apparatus of this invention, the paper engaging means is comprised of a multitude of identical angled stiff wires held in parallel alignment by a base structure, the free ends of said wires being disposed in a plane parallel to the axis of said core. Suitable paper engaging means may, for example, be selected from carding cloth material utilized in the fibers industry to comb or parallelize staple fibers of relatively short length. The paper engaging means is preferably associated with the front panel or floor of the holding means. In a particularly preferred embodiment of the invention, the floor is downwardly inclined toward the front panel, causing gravitational movement of the roll toward the front panel and into contact with the engaging means as the diameter of the roll diminishes during use. The side retaining members may be flat panels which, in combination with the front panel and floor form a box-like enclosure. Rear and top panels may be utilized in certain embodiments.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
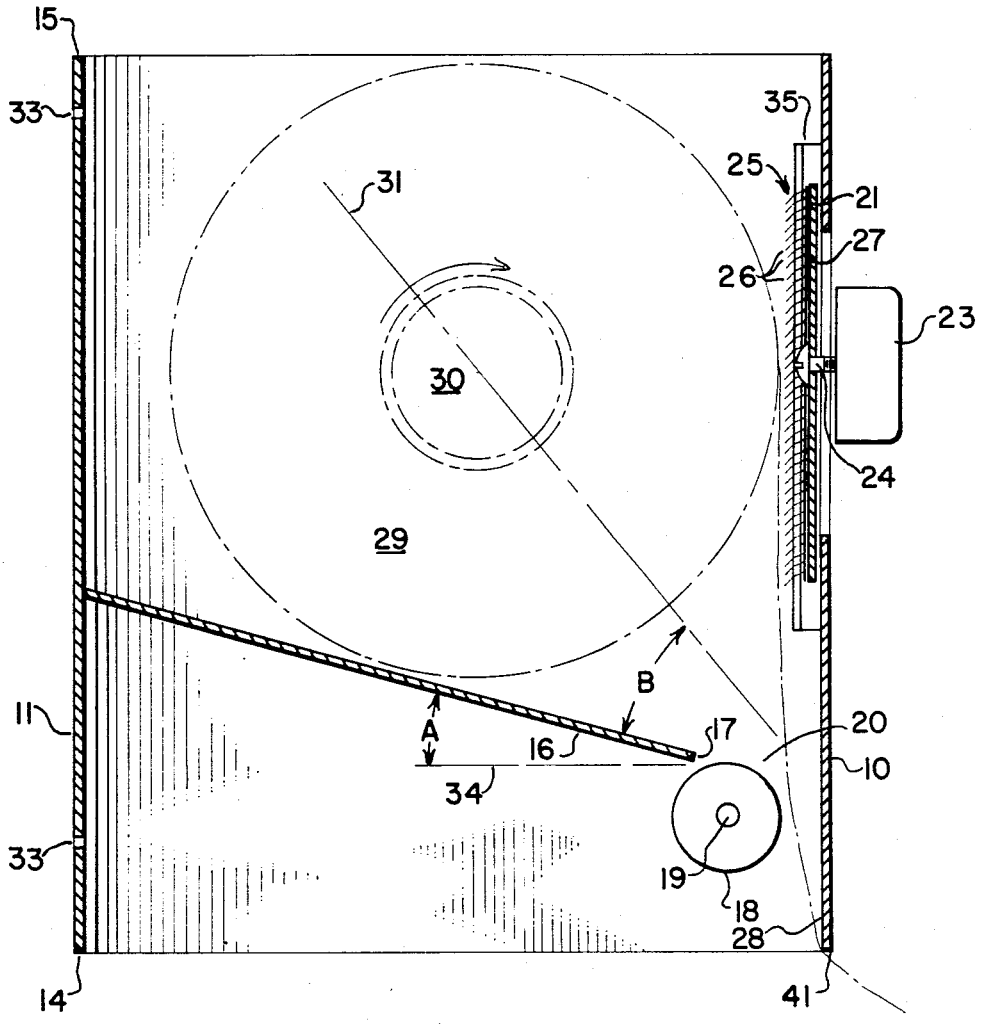
FIG. 1 is a sectional side view of an embodiment of the apparatus of the present invention.

Referring to the drawing, the illustrated embodiment of the apparatus of the present invention is shown to be comprised of an enclosure formed by front panel 10, opposed rear panel 11 and side retaining members in the form of panels 12 and 13. Said panels are fabricated of rigid, flat sheet stock such as aluminum, plastic, laminated or composite wood, or other equivalent materials. Cardboard may be utilized for fabrication of the panels when the apparatus is intended to be of a low cost, disposable nature. The panels are adapted for vertical orientation. The horizontally taken cross-section of the enclosure is rectangular and substantially uniform between lower extremity 14 and upper extremity 15. Side panels 12 and 13 are of substantially identical dimensions. Rear panel 11 may in certain embodiments be of shorter height than the remaining panels and may be provided with holes 33 to facilitate mounting to a vertical support surface. The panels are interconnected by adhesives, welding, soldering, or equivalent methods. In some embodiments, the four panels of the enclosure may be comprised of an appropriately shaped single monolithic structure, and some embodiments of the enclosure may be provided with an upper closure lid.

A flat floor 16 is positioned within said enclosure in a manner such that it is downwardly angled in going from rear panel 11 toward front panel 10. The floor, which is preferably a panel but may be a series of parallel rods or equivalent structure, forms an acute angle with horizontal line 34, the value of said angle, designated angle A in FIG. 1, ranging from about 10° to 15°. Angles smaller than 10° will not produce sufficiently positive downward feed of a roll of paper tissue supported by the floor panel. Angles greater than 15° lead to the jamming or deformation of such rolls of paper. The floor panel is perpendicularly disposed to both side panels 12 and 13. Securement of the floor panel within the enclosure may be achieved by engagement of the rear and side edges of the floor panel with the inside faces of the rear and side panels, said engagement being effected by adhesives, recessed grooves within said panels, or use of mechanical fastening means. In its traversal of the enclosure, the floor panel terminates in a straight forward edge 17 spaced apart from front panel 10 and parallel thereto. A horizontal gap 20 is thereby formed, its purpose being to permit downward passage of tissue from said enclosure, as will hereinafter be shown.

A guide roll 18 of circular cylindrical configuration, and having center axle 19, is rotatively journaled by said axle to side panels 12 and 13 in a manner such that the rotational center axis of said roll is perpendicularly disposed to said side panels at an elevation below said floor panel and adjacent forward edge 17 thereof.

Front panel 10 contains centered therein an elongated vertical aperture 22. A manipulating handle 23 disposed upon front panel 10 is joined by connecting post 24 to plate 21 upon which is mounted two pieces of carding material 25. The connecting post permits vertical reciprocal sliding movement of handle 23 and attached carding material 25 within the constraints of aperture 22. Opposed brackets 35 serve as guide means to prevent torsional movement of plate 21 with respect to handle 23. The carding material is comprised of a multitude of substantially identical downwardly angled parallel pins 26 anchored in backing material 27. The vertically disposed length of the piece of carding material is such as to cause contact with the paper at both extremes of its reciprocating motion at all diameters of the paper roll. Said backing material is positioned in flush engagement with the interior face of plate 21. Tissue engaging means other than the specifically exemplified carding material may be utilized provided that the engaging means advances paper only on the downstroke of handle 23. With the paper engaging means in a given stationary position in contact with the paper, the paper cannot be easily unrolled without tearing. This feature imposes control of the rate of removal of paper from the roll.

Figure 2:
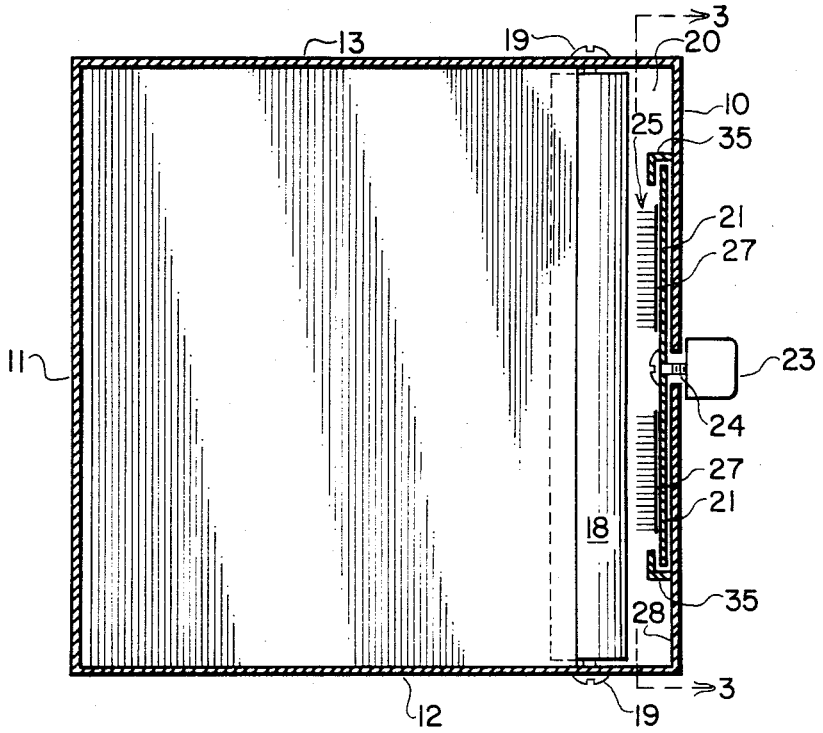
FIG. 2 is a top view of the apparatus of FIG. 1.
Figure 3:
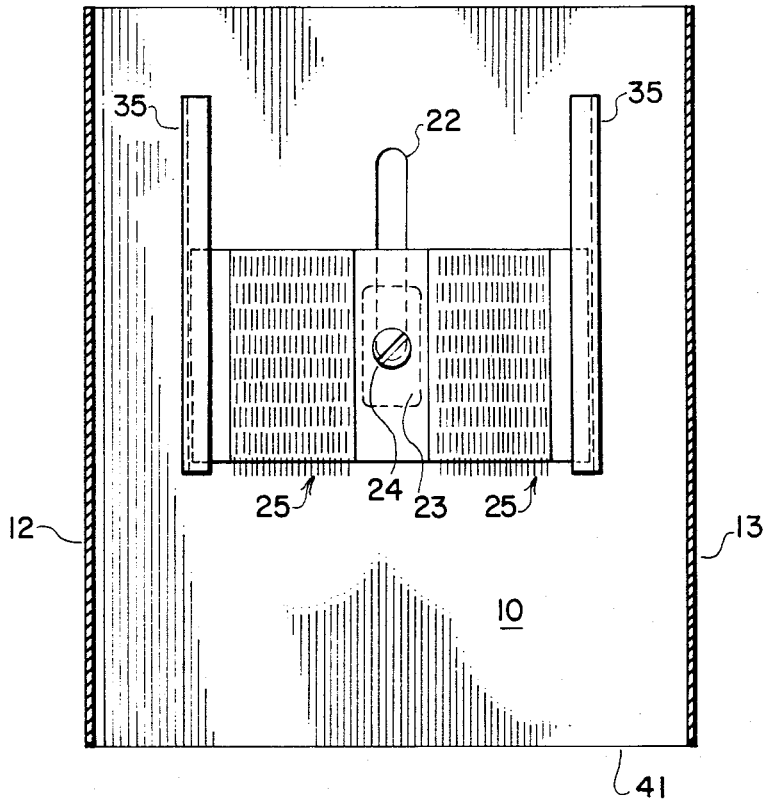
FIG. 3 is a sectional view taken along the line 3—3 of FIG. 2.

In the operation of the apparatus of FIGS. 1–3, a spirally wound roll of tissue paper 29 is placed within the enclosure in a manner such that its cylindrical core 30 is perpendicularly disposed to side panels 12 and 13, and the paper is disposed to unwind downwardly from the upper part of the roll. The leading edge of the paper is entered through gap 20. By manually moving handle 23 in an up-and-down manner, tissue is unwound from the roll on the downward stroke of the handle because of the gripping action of the carding material. The paper unwinds from the roll in the direction shown by the arrow in FIG. 1. On the upward stroke, the paper is not moved. When sufficient paper is disposed below gap 20, it is torn off utilizing tear assisting means in the form of straight lower edge 41 of front panel 10 disposed below floor panel 16.

In the course of continued use, the diameter of the roll of paper decreases. However, the inclined floor panel maintains constant contact of the roll with the carding material. The path taken by the center of cylindrical core 30 is represented by the line 31 in FIG. 1, which forms an angle B with floor panel 16 having a value between about 30° and 40°. As the partially unwound roll of paper 29 approaches guide roll 18, said guide roll maintains the paper in proper position to be acted upon by the carding cloth and further prevents the possibility that the roll of paper or empty core 30 will become wedged between the forward edge 17 of floor panel 16 and front panel 10.

Figure 4:
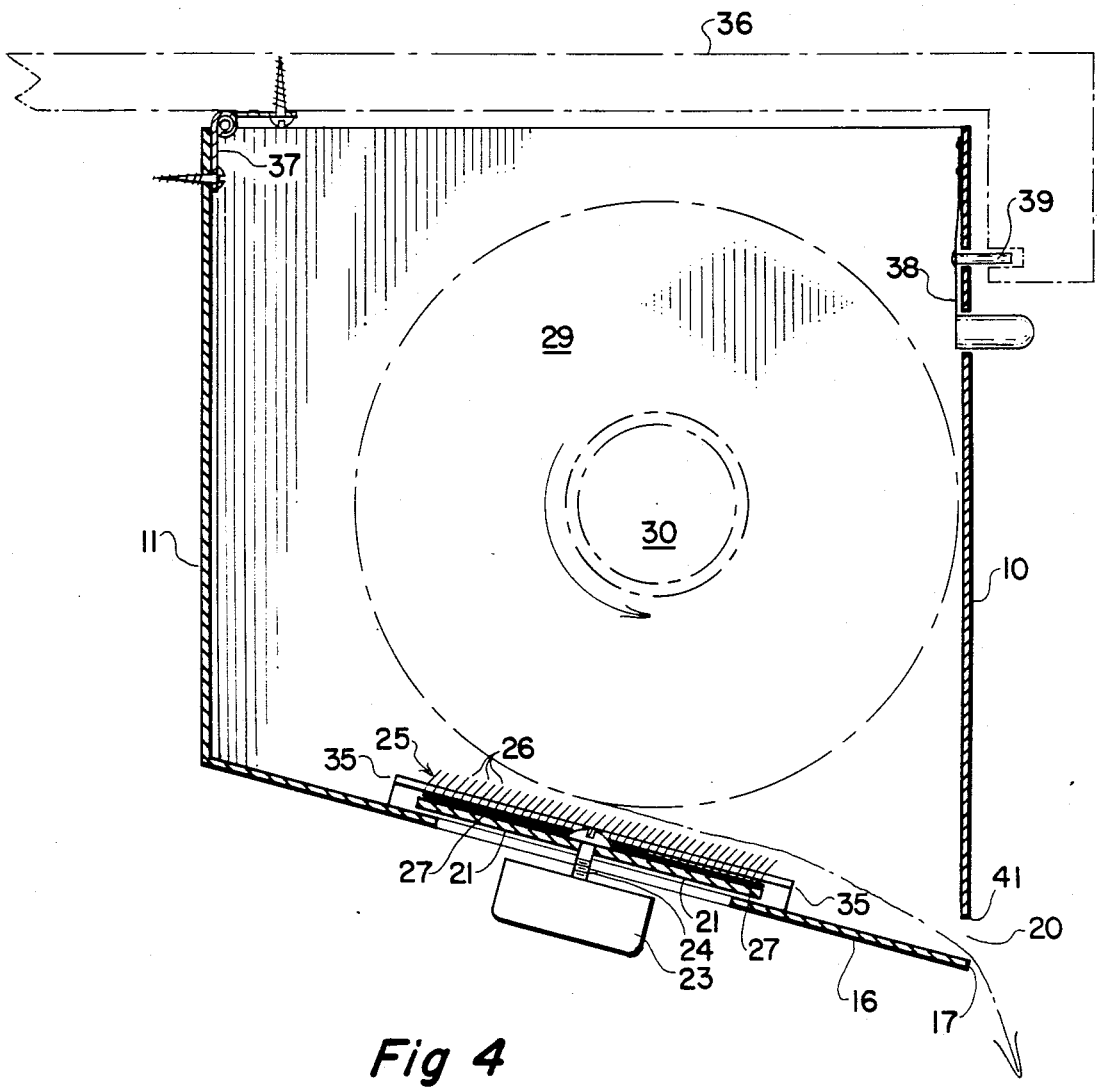
FIG. 4 is a sectional side view of an alternative embodiment of the apparatus of this invention.

FIG. 4 illustrates an embodiment of the apparatus of this invention wherein the paper gripping means and its manipulating handle 23 are associated with floor panel 16 instead of front panel 10. The linear reciprocal motion and general function of the gripping means are essentially the same in the embodiments of FIGS. 1 and 4, however, the paper is removed horizontally from the bottom of the roll in the embodiment of FIG. 4. The configuration of the embodiment of FIG. 4 is generally suitable for mounting to an overhead support surface such as the lower shelf 36 of a kitchen cabinet. In such manner of mounting, the apparatus may in fact be recessed into a cabinet so as to be concealed from view without impairment of its functionality. It is to be noted that horizontal gap 20 is disposed within front panel 10 in the apparatus of FIG. 4, and forward edge 17 of said floor panel serves as tear assisting means. Attachment of the apparatus of FIG. 4 to overhead shelf 36 may be achieved by screw-held hinge 37, and depressible spring 38 adapted to releasably engage post 39 associated with shelf 36. It is to be understood that a rear panel is not necessary in the apparatus of this invention, especially in those applications where the apparatus is applied to a vertical wall which then serves as a rear panel for the apparatus.

In certain embodiments, a reserve second roll of spirally wound tissue paper may be positioned within the enclosure above the first roll in use. Upon complete utilization of said first roll, the second roll may be brought into the position of the first roll by manual or automatic manipulation.

The use of an inclined floor exemplifies the use of gravity to urge the roll with substantially constant force against the paper engaging means. However, it is to be understood that other expedients may be utilized as means for forcing the roll of paper into contact with the engaging means, such expedients including tensioning devices and levering means.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. Apparatus for dispensing paper tissue from a spirally wound roll on a hollow core comprising:

(a) holding means for functionally supporting and positioning said roll comprised of two opposed side retaining members, a front panel adapted to be vertically oriented and a floor having a forward extremity adjacent said front panel, said floor being substantially perpendicularly disposed to said side retaining members which are spaced apart sufficiently to accommodate therebetween said roll supported by said floor in a manner such that said core is horizontally disposed, (b) an opening within said holding means associated with the forward extremity of said floor in perpendicular orientation to said side retaining members and adapted to permit passage therethrough of paper from said roll, and (c) carding material slideably supported by said holding means and adapted for reciprocal motion in a linear path, said carding material being adapted to advance the paper of said roll when moved in one direction, and not move the paper when moved in the reverse direction, said carding material having a length such as to cause contact with the paper roll at both extremities of its reciprocal motion at all diameters of the paper roll, (d) whereby paper can be moved from said roll at a rate controlled by the motion of said carding material.

2. The apparatus of claim 1 wherein said side retaining members and said floor are panel structures.

3. The apparatus of claim 1 wherein said floor is downwardly inclined toward said front panel.

4. The apparatus of claim 1 wherein said holding means is further provided with a rear panel.

5. The apparatus of claim 4 wherein said holding means has a box-like configuration.

6. The apparatus of claim 1 provided with paper tearing means associated with said holding means adjacent the forward extremity of said floor.

7. The apparatus of claim 1 provided with handle means adapted to facilitate manual movement of said paper engaging means.

8. The apparatus of claim 2 provided with a circular cylindrical roller rotatively journaled to said side panels and horizontally positioned below said floor panel and below said opening and parallel thereto.

9. The apparatus of claim 1 provided with mounting means to facilitate attachment to a vertical support surface.

10. The apparatus of claim 1 wherein said paper engaging means is associated with said front panel.

11. The apparatus of claim 1 wherein said paper engaging means is associated with said floor.

* * * * *